US007443375B2

(12) United States Patent
Kieschnick et al.

(10) Patent No.: US 7,443,375 B2
(45) Date of Patent: Oct. 28, 2008

(54) DISPLAY DEVICE WITH PIXEL INVERSION

(75) Inventors: Knut Kieschnick, Böblingen (DE); Eckart Rzittka, Wildberg-Sulz (DE); Marko Radovic, Wildberg-Sulz (DE)

(73) Assignee: NXP B.V., Eindhoven (NL)

( * ) Notice: Subject to any disclaimer, the term of this patent is extended or adjusted under 35 U.S.C. 154(b) by 369 days.

(21) Appl. No.: 10/534,161

(22) PCT Filed: Oct. 27, 2003

(86) PCT No.: PCT/IB03/04783

§ 371 (c)(1),
(2), (4) Date: May 5, 2005

(87) PCT Pub. No.: WO2004/044879

PCT Pub. Date: May 27, 2004

(65) Prior Publication Data

US 2006/0158418 A1 Jul. 20, 2006

(30) Foreign Application Priority Data

Nov. 9, 2002 (DE) ..... 102 52 166

(51) Int. Cl.
*G09G 3/36* (2006.01)

(52) U.S. Cl. ..... 345/100

(58) Field of Classification Search ..... 345/96, 345/100, 209, 204, 103
See application file for complete search history.

(56) References Cited

U.S. PATENT DOCUMENTS 5,093,655 A * 3/1992 Tanioka et al. ..... 345/96
5,253,091 A * 10/1993 Kimura et al. ..... 345/94
5,436,635 A * 7/1995 Takahara et al. ..... 345/92
5,774,099 A * 6/1998 Iwasaki et al. ..... 345/87
6,545,653 B1 * 4/2003 Takahara et al. ..... 345/87
6,806,862 B1 * 10/2004 Zhang et al. ..... 345/103
2003/0151584 A1 8/2003 Song et al.
2003/0189537 A1 * 10/2003 Yun ..... 345/87

FOREIGN PATENT DOCUMENTS

| | | |
|---|---|---|
| EP | 0 899 712 | 3/1999 |
| EP | 1 037 193 | 9/2000 |
| EP | 1 164 567 | 12/2001 |

OTHER PUBLICATIONS

Lee Seung-Woo et al "Pixel Arrangement for Low-Power Dot Inversion Liquid Crystal Display Panels" Electronics Letters, IEE Stevenage, GB, vol. 34, No. 16, Aug. 6, 1998, pp. 1604-1606.
Patent Abstracts of Japan vol. 017, No. 515 (P-1614) Sep. 16, 1993.

* cited by examiner

*Primary Examiner*—Richard Hjerpe
*Assistant Examiner*—Shaheda A Abdin

(57) ABSTRACT

A display device includes pixels arranged in columns and rows, in which the pixels of a row can be selected by means of a row voltage supplied via control lines, and column voltages that correspond to the image data of the selected pixel to be displayed can be supplied via data lines, wherein mutually adjoining pixel groups arranged in a row or column, consisting of adjoining pixels of a row or column, are connected to adjoining control lines or data lines, as applicable, in alternation.

14 Claims, 4 Drawing Sheets

Odd Fields

Even Fields

DISPLAY DEVICE WITH PIXEL INVERSION

Figure 1:
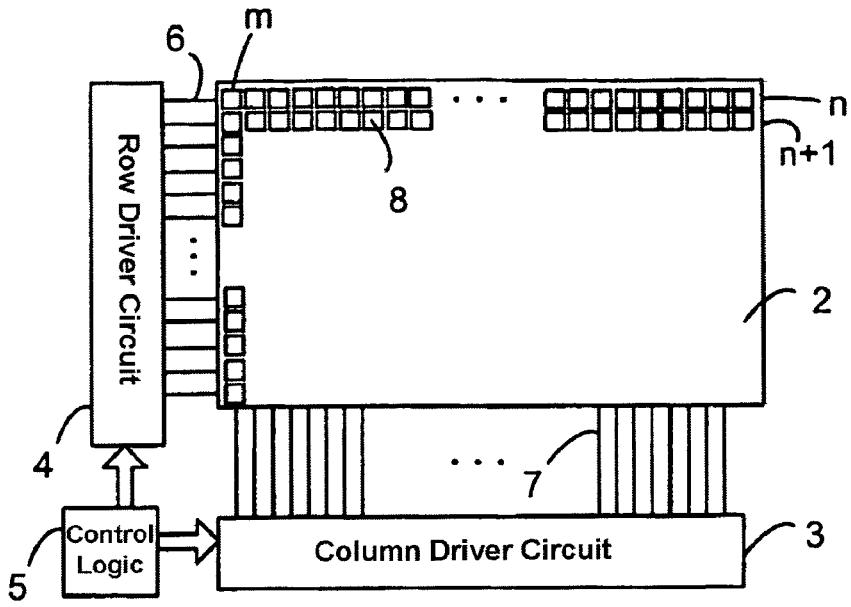

The invention relates to a display device with pixels arranged in columns m and rows n, in which the pixels of a row n can be selected by means of a row voltage supplied via control lines, and column voltages which correspond to the picture data of the selected pixel to be displayed can be supplied via data lines. Furthermore, the invention relates to a method of controlling such a display device.

Display devices are important components for information and communication technology. As the interface between man and the digital world, a display device or display for short is of central importance for the acceptance of modern information systems. Two kinds of displays are distinguished in principle. These are passive matrix displays on the one hand, and active matrix displays on the other. The invention relates in particular to active matrix displays, which are used inter alia in laptops, mobile telephones, digital cameras, and the automotive field.

Fast picture changes, for example the representation of a mouse cursor or of moving images, can be realized with active matrix displays. The pixels are actively controlled in this active matrix LCD technology. The embodiment that is most widely used works with thin-film transistors (TFT). A display is built up typically of pixels arranged in rows and columns. Each pixel comprises at least one switching element and one capacitor for holding the voltage until the next row sweep. The switching elements are mostly constructed as TFT transistors. The image signals are made visible in the pixel then by means of the transistors, for example made of silicon, which are directly integrated into each pixel. The rows of a display device are controlled sequentially with given row voltages. The row voltage activates the gates of the TFT transistors in the respective row, whereby said row is selected. The columns of the display device are connected to data lines. The column voltages ($V_{col}$) applied to the respective data lines of the display device then switch on the pixels of the activated line in dependence on the applied column voltage. This column voltage is passed through the TFT transistor into a storage capacitor present in the pixel, which keeps or stores this voltage or charge until the next row sweep. The column voltages are of different values here, the value of the column voltage to be generated being dependent on the grey level to be displayed. The different column voltages applied to the respective data lines cause the liquid crystals in the pixels to rotate to different degrees, so that more or less light radiated from behind (backlight) or ambient light radiated from the front and reflected back can arrive at the viewer in dependence on the rotation, which manifests itself in a different grey level for the viewer. Transflective displays are capable of reflecting light from the front and of transmitting light through the display from the back. Color filters are used for the representation of colors. Several TFT transistors are integrated into one pixel for a display with several different colors, and a plurality of color filters is arranged in front of the display. The TFT transistors of a pixel are then switched on jointly or individually in dependence on the color or colors to be displayed.

Liquid crystal display (LCD) modules are typically made of a glass with row and column connections passed to the exterior, to which driver circuits or control arrangements are connected. The image information is stored as digital image signals or image data, for example in storage devices, or is supplied to the drivers by other electronic circuit arrangements. These digital image signals are to be converted into analog signals, so that a suitable luminous intensity can be displayed by means of an analog voltage. The digital-to-analog converters necessary for this conversion convert the digital image signals into voltages which lie in a range from below 20 mV to more than 15 V. Since these high voltages are to be generated by means of charge pumps or charge multipliers in portable appliances, it is particularly important that the available voltage should be utilized as effectively as possible, or that control methods are used for which low voltages suffice.

The energy consumption is a particularly important criterion in portable electronic appliances because the operational life of the battery of the appliance, and thus the period of use of the appliance, depend on this.

Furthermore, the acceptance of displays depends on the quality with which the image information is displayed. The polarity of the voltages applied to the pixels is periodically changed so as to reduce the degradation of the liquid crystals of the display.

Several methods are known for this purpose. On the one hand, the polarity of the voltages may be reversed at each image traversal. This is denoted frame inversion. The voltages are periodically inverted, i.e. after each frame, so that the polarity is changed simultaneously for all pixels. An energy-saving control with low column voltages is possible here. It is a disadvantage, however, that a wide-area flickering arises, which detracts from the display quality. A row inversion is used for counteracting this flickering. The polarity of the row voltages is changed here for consecutive rows, whereby the wide-area flickering is reduced, while still a control with low column voltages is possible. A disadvantage of row inversion, however, is a rise in energy consumption.

An alternative to row inversion is column inversion, which achieves an identical result to that of row inversion as regards the reduction of flickering. The energy consumption is lower than with row inversion, but a control with low column voltages is not possible, which considerably increases the circuitry expenditure for the column driver circuit or source driver.

Pixel inversion is a combination of row inversion and column inversion. Flickering is reduced most strongly here, but at the cost of a higher energy consumption. In addition, a control with low column voltages is not possible here either.

The use of low voltages for controlling the display device is important on the one hand in particular for battery-operated appliances so as to prolong their period of use with one battery charge. On the other hand, a control with high voltages requires a high-voltage manufacturing process, which raises the manufacturing cost in addition to the higher energy consumption during operation of such circuits.

EP 0 899 712 describes a display device in which a row and column inversion are combined so as to achieve a pixel inversion. Two column driver circuits are used for achieving the supply of low column voltages, one column driver being located above the display device and controlling each second column. A further driver is located below the display device and controls the other columns. To achieve a pixel inversion, the mutual connections between the column drivers arranged above and below on the one hand and the columns on the other hand are interchanged each time by the analog switch for the purpose of column inversion. This has the advantage essentially that no changes are required in the architecture of the display device. A disadvantage is the higher power consumption of the entire display module, while furthermore there is a requirement for two column driver circuits or a driver chip with double the number of outputs. Both arrangements are not fundamentally suitable for complying with future requirements imposed on the cost of display modules.

U.S. Pat. No. 6,335,719 describes a circuit in which a pixel inversion is combined with a field inversion so as to prevent flickering in the case of repeating images. The display is subdivided into a number of fields which are controlled with mutually opposed polarities in addition to the pixel inversion. To realize such a display, the circuit technology of the drivers is changed such that individual regions of the display have mutually different polarities.

Against this background, it is an object of the invention to provide a display device in which an optimized image quality is achieved in combination with an equally long battery life and a low manufacturing cost.

This object is achieved by means of a display device with pixels arranged in columns and rows, in which the pixels of a row can be selected by means of a row voltage that is supplied via control lines, and column voltages that correspond to the image data of the selected pixel to be displayed can be supplied via data lines, wherein mutually adjoining pixel groups arranged in a row or column, consisting of adjoining pixels of a row or column, are connected to adjoining control lines or data lines, as applicable, in alternation.

The invention is based on the idea of combining the simplicity of row inversion with the quality of pixel inversion.

For this purpose, the first pixel group comprising, for example, two mutually adjoining pixels in a horizontal row is connected to a first adjoining control line, the next, adjoining pixel group in this horizontal row is connected to the other adjoining control line. The same may be realized for a column. Adjoining pixel groups in a column, for example three pixels arranged below each other, are connected to a first data line, and the next pixel group is connected to the other, adjoining data line. This results in a row or column in the form of a sawtooth or a zigzag row or column as far as the control with the row voltage or column voltage is concerned. In the control with the row voltage, pixel groups from the horizontal first row as well as pixel groups from the horizontal second row are connected to the control line in question and are selected by a row voltage. As a result, the horizontally adjoining pixel groups always have opposed polarities. It is only every second pixel group in a horizontal row that will have the same polarity again. The same holds for the application of the invention to the columns. Pixel groups from a first vertical column are then connected to a data line, as are pixel groups from the adjoining second vertical column, so that in this case again an alternating polarity is found for the mutually adjoining pixel groups in a vertical column. The circuitry corresponds to the conventional connection of pixels to control and data lines. Depending on the embodiment, the control connections of the pixels are to be joined alternately to the adjoining control or data lines. In an advantageous embodiment of the invention, a pixel group comprises one pixel. This achieves a pixel inversion with a control expenditure of a conventional display having line inversion.

A pixel comprises switching elements with a control terminal connected to a control line. This control terminal is, for example, the gate of a transistor which serves as a switching element in the respective pixel.

In a further advantageous embodiment of the invention, a delay unit is connected to every second data line so as to render possible the control with a conventional control method in a display device in which mutually adjoining pixels in a horizontal row are alternately connected to the two adjoining control lines, which delay unit is provided for storing supplied column voltage values, while a clock signal can be supplied to the delay units. The column voltage values are usually read from a memory and supplied to the display device. The column voltages then correspond to the grey levels of the picture data to be displayed. The arrangement according to the invention of the display device renders it necessary for these column voltages to be supplied to the display device in a different manner compared with what is possible for conventional display devices. The circuitry expenditure, however, is very low. Depending on the embodiment of the invention, a delay unit is connected to each second data line and is fed with a clock signal. Upon a first clock signal, the column voltage value is directly supplied to the column without delay unit and the correspondingly activated pixel in the selected row can switch on or rotate its liquid crystals such that the desired grey level is shown. The columns to which delay units are connected obtain the column voltage value stored in the delay unit with the same clock signal. The column voltage value applied to the input of the delay unit is stored during reading-out of the stored column voltage value, and the former value is then read out upon the next clock signal and supplied to the pixels of the next selected zigzag row. The correct column voltage is thus supplied each time in a conventional row sweep. No further change in the architecture is necessary. If pixel groups are alternately connected to the adjoining control lines instead of adjoining pixels in the alternative embodiment of the invention, a number of delay units is to be connected to the adjoining data lines corresponding to the number of pixels in a pixel group. For example, pixel groups consisting of two adjoining pixels require two delay units connected to two respective data lines, and the next, adjoining data lines are controlled without delay units.

In a further advantageous embodiment, the rows and columns situated at the edge of the display device are covered, because in the rows or columns at the edge each second pixel group or each second pixel only is controlled each time in the arrangement of the invention. These rows or columns are so-called blind rows or columns.

This architecture achieves that the display device according to the invention is controlled as a conventional display device. The quality of a pixel inversion combined with the circuitry expenditure of a row inversion is thus obtained for the display device when it is controlled with this row inversion. The same holds for the embodiment with column inversion. This also renders possible a control with low voltages, which is particularly important for the application of battery-operated appliances. The flickering problem is optimally eliminated, as in the case with pixel inversion. No further ITO layer is necessary for realizing the modified control connections in manufacture, so that also the manufacturing cost is not increased.

Figure 2:
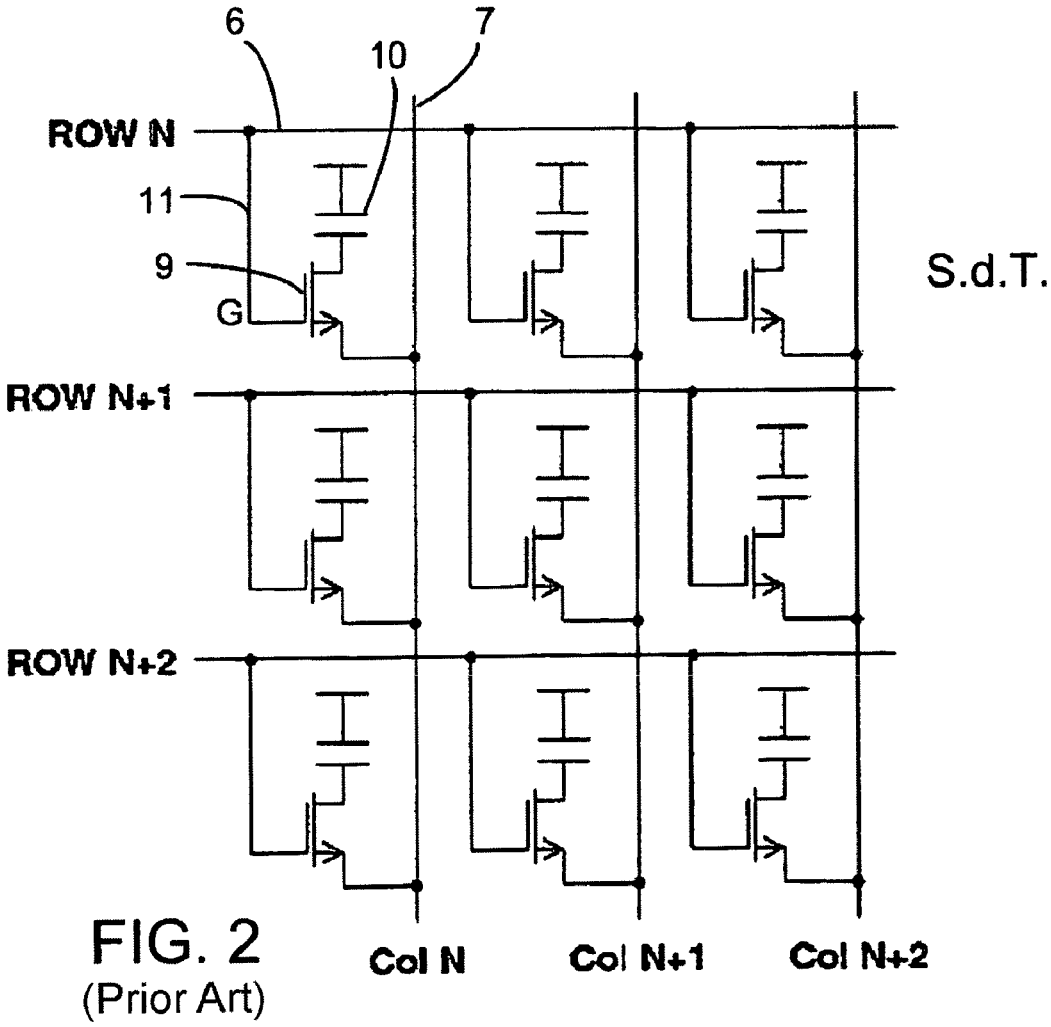
FIG. 2 (Prior Art)
Figure 3:
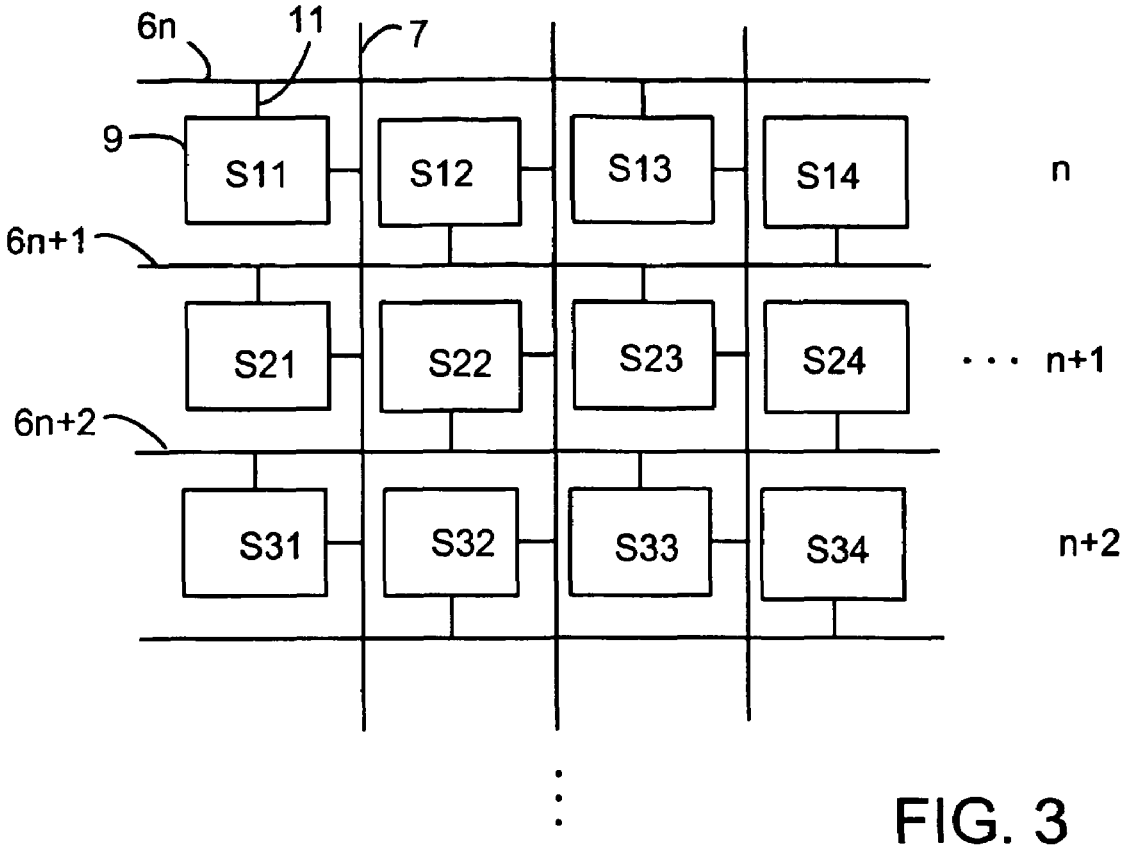
Figure 4:
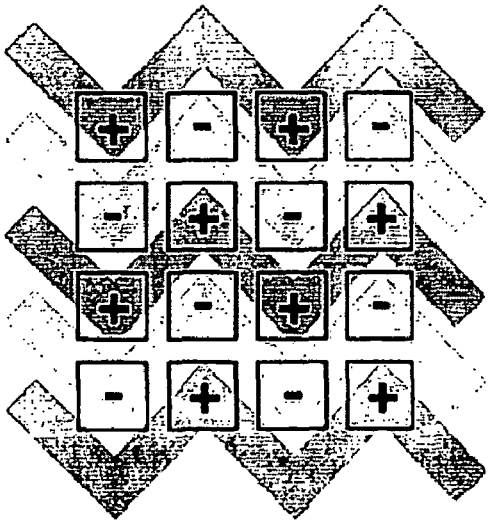
Figure 5:
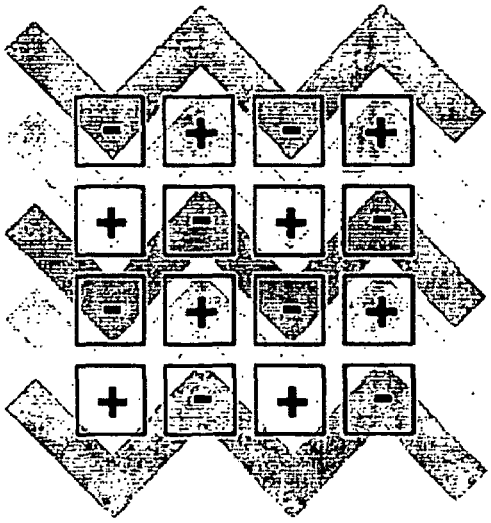
Figure 6:
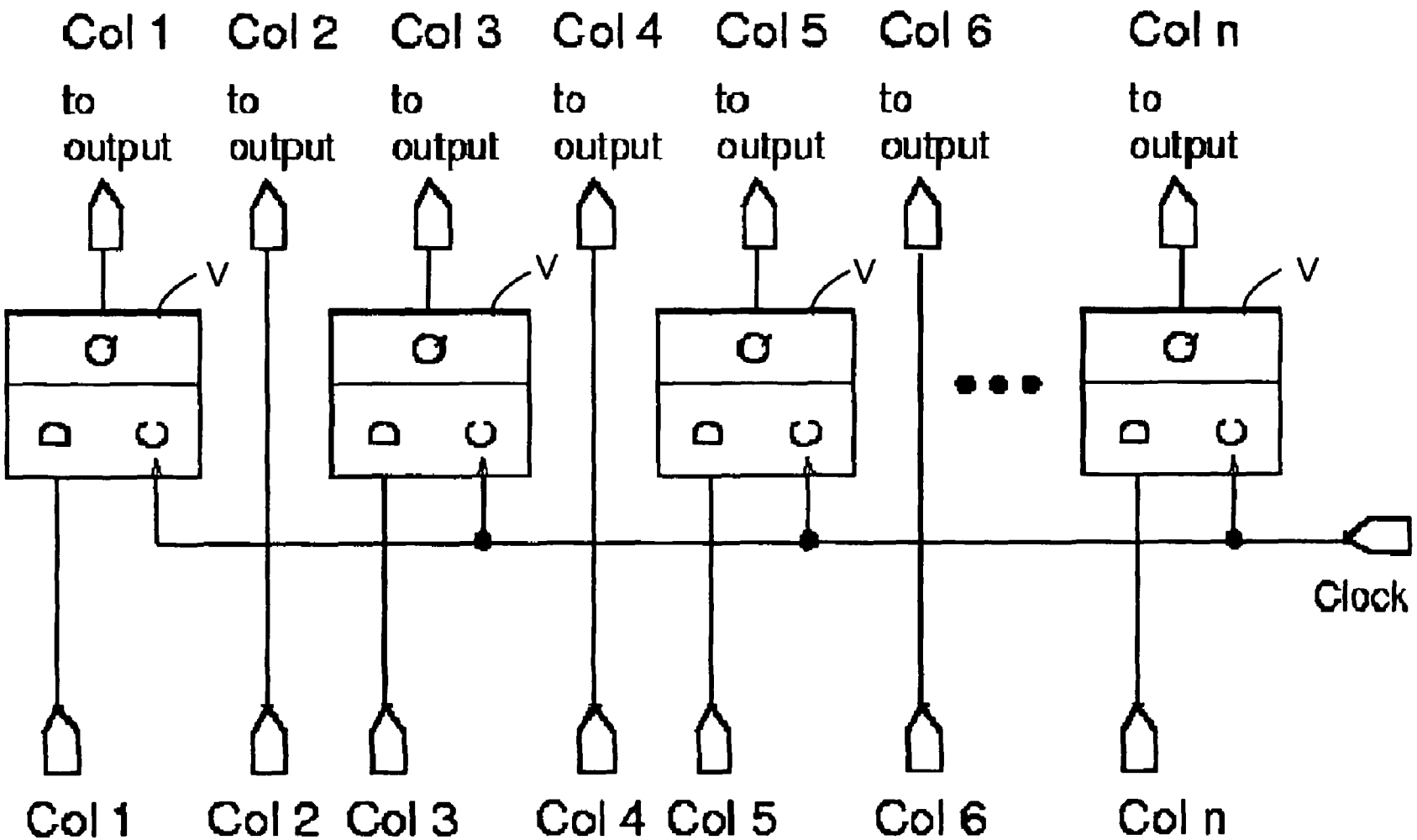
Figure 7:
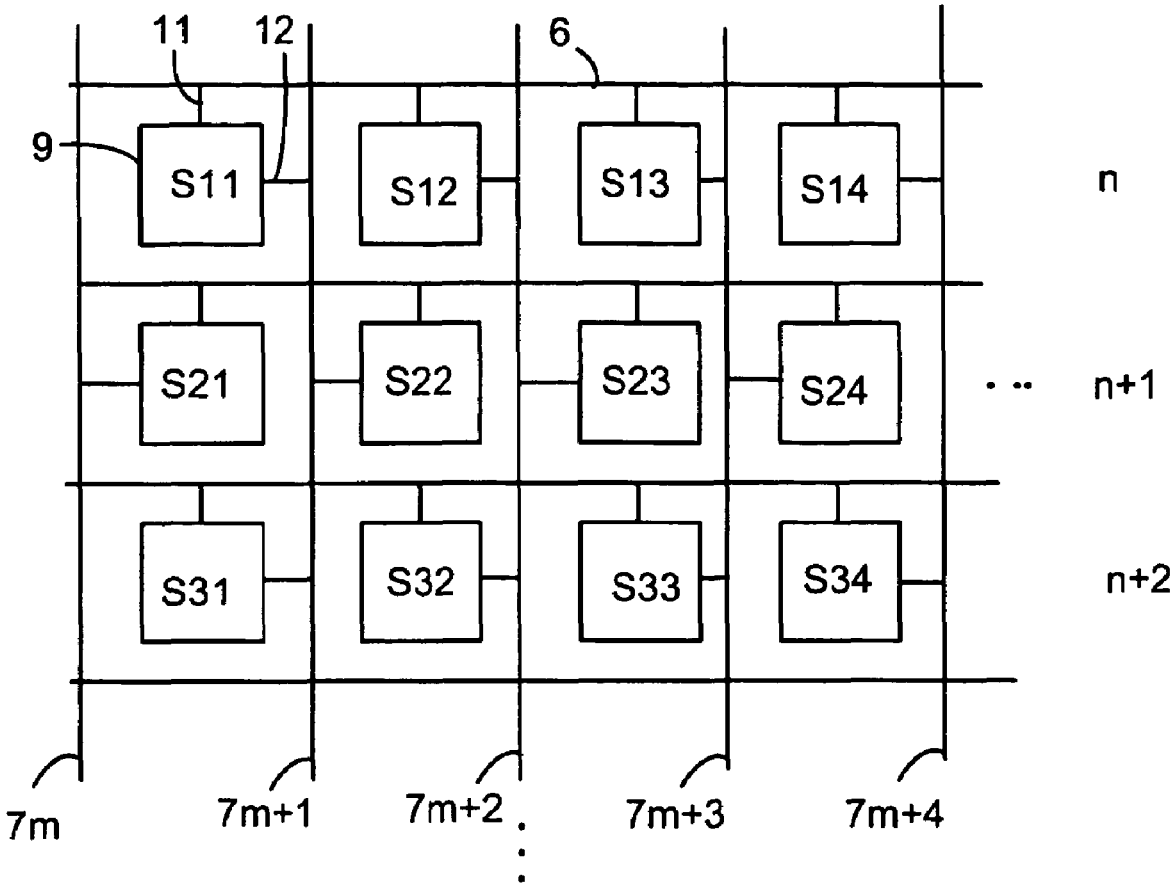

Embodiments of the invention will be explained in more detail below with reference to the drawing, in which:

FIG. 1 is a block diagram of a display device,

FIG. 2 is a circuit diagram of a pixel arrangement according to the prior art, FIG. 3 is a circuit diagram of a display device according to the invention, FIG. 4 shows the connections of the pixels, FIG. 5 shows alternative connections of the pixels, FIG. 6 is a circuit diagram for the control of a display device of FIG. 3, and FIG. 7 is a circuit diagram of an alternative display device according to the invention.

FIG. 1 is a block diagram of the control of a display 2. A column driver circuit 3 and a row driver circuit 4 are connected to the display.

The display device 2 comprises pixels 8 which are arranged in rows n and columns m. The rows n are selected via control lines 6. The row voltages $V_{ROW}$ are supplied to the rows via these control lines. The column voltages $V_{COL}$ are supplied to the columns m via data lines 7. The rows n of the display device are sequentially selected in principle. It is possible in special control methods, for example, to select only the even rows in one traversal, and to control the odd rows in the next traversal. The row voltage $V_{ROW}$ may lie in a range from $V_{max}$=+14 V to $V_{min}$=−12 V. The column voltage $V_{COL}$ may vary from $V_{colmin}$=0 V to $V_{colmax}$=5 V, in dependence on the grey levels to be shown. The picture data to be displayed are deposited in a memory (not shown) or are generated by a unit which is not shown. The control logic 5 controls the voltage supply to the driver circuits 3 and 4 and the supply of the control signals to the row driver circuit 4. The rows of the display are sequentially selected by the row driver circuit 4, i.e. a suitable row voltage is supplied to that row which is instantaneously active. The column driver circuit 3 supplies column voltages to the columns of the display which correspond to the picture data to be displayed in the active row. The combination of column voltages and the row voltage causes the liquid crystals of the pixels of the active row to assume rotational positions which correspond to the respective grey levels of the picture data to be displayed. After one row of the display has been controlled and the picture data have been shown, the row driver circuit activates the next row. The column driver circuit supplies the relevant column voltages beforehand, corresponding to the picture data of this next row. After all rows of a display have been traversed, a new traversal is started.

FIG. 2 diagrammatically shows the pixels of a conventional display device according to the prior art. The pixels 8 (cf. FIG. 1) controlled simultaneously with one row voltage are arranged in a horizontal row. The control connections of the TFTs or the switching elements 9 are each connected only to one control line 6. A pixel 8 mainly comprises a switching element 9, which is formed by a TFT transistor 9 here. A storage capacitor 10 stores the charge until the next row traversal. The TFT transistor 9 is connected to the control line 6 and the data line 7. The row voltage $V_{ROW}$ is supplied through the control line 6. The gate G of the TFT transistor 9 is activated by this row voltage $V_{ROW}$. The row voltage opens the gates of all TFT transistors of the pixels present in this row. The moment the gates of the TFT transistors are open, the corresponding column voltages VCOL are supplied through the respective data lines 7, so that the pixels of the selected row display the correct grey levels.

FIG. 3 is a circuit diagram of a pixel arrangement according to the invention. Here the control terminals 11 of the switching elements 9 of one horizontal row are alternately connected to the adjoining control lines 6, such that the first switching element $S_{11}$ of the first row n is connected to the control line 6*n*, the second switching element $S_{12}$ of the first row n to the control line 6*n*+1, the switching element $S_{13}$ of the first row to the control line 6*n*, etc.

In the next row n+1, the first switching element $S_{21}$ of the row n+1 is connected to the control line 6*n*+1, the switching element $S_{22}$ of the row n+1 to the control line 6*n*+2, and the next switching element $S_{23}$ of the row n+1 to the control line 6*n*+1, etc.

FIGS. 4 and 5 show how the polarity of the pixels changes, although only a single row inversion is used. The change in polarity of the row voltages supplied to the control lines forms a row similar to a zigzag line or a sawtooth shape. As a result, the rows are optically interlocked such that mutually adjoining pixels in a horizontal row always have different polarities. FIG. 4 shows the control with a first polarity. FIG. 5 shows the subsequent, opposed polarity of the rows.

FIG. 6 shows a circuit for controlling a display device as shown in FIG. 3. Data from a memory (not shown) are supplied to the columns $Col_1$ to $Col_N$ here. Each second column is directly switched through to the pixels. A delay unit V is connected upstream of the odd columns $Col_1$, $Col_3$, $Col_5$, etc. in this example, which unit is formed by a D-flip-flop here. A clock signal CLOCK is supplied to the delay unit V at their clock inputs C. The digital values representing the column voltages are supplied to the data inputs D of the delay units V. The outputs Q of the delay units V are connected to the respective data lines of the columns $Col_1$, $Col_3$, $Col_5$, etc. of the display device. For the first row, which is only partly connected to the first control line, it is only the directly connected digital values for the column voltages that are supplied to the activated pixels of the first row. The digital values of the column voltages for the odd columns $Col_1$, $Col_3$, $Col_5$, etc. are put into temporary storage in the delay units V. The values stored in the delay units V are supplied to the odd columns upon the next clock signal. This delay of the column voltage renders it possible to control the display device according to the invention as shown in FIG. 3 by a normal or conventional control method.

FIG. 7 shows an alternative embodiment of the display device according to the invention, in which adjoining pixels S11, S21, S31 of a column are alternately connected to the two adjoining data lines 7*m*, 7*m*+1. The first switching element $S_{11}$ is connected to the data line 7*m*+1, the second switching element $S_{21}$ to the data line 7*m*, and the third switching element $S_{31}$ to the data line 7*m*+1. The same holds for the pixels of the next columns. Such a display can be controlled by a method of controlling display devices in which the row voltages for the rows without delay units are supplied to the pixels connected to the control line and the pixels are activated with the clock signal, and in which the row voltage values stored in the delay units are supplied to the connected pixels, and the row voltages applied to the control lines for the rows with the delay units are read into the delay units upon the clock signal and are stored there until the next clock signal. The control method described here is not applicable for a TFT display. The control terminals of the row are connected to the respective gates of the thin-film transistors, which means that the same waveform is applied to all gate terminals in the respective row. A pixel inversion, however, can only be achieved if mutually adjoining pixels in one row receive different waveforms at their gates, which is not possible with this embodiment and the control method herein.

The invention claimed is:

1. A display device with pixels arranged in columns and rows, in which the pixels of a row can be selected by means of a row voltage supplied via control lines, and column voltages that correspond to the image data of the selected pixel to be displayed can be supplied via data lines, wherein mutually adjoining pixel groups arranged in a row or column, consisting of adjoining pixels of a row or column, are connected to adjoining control lines or data lines, as applicable, in alternation, some of the control lines being connected to a plurality of delay units such that only every other control line is connected to a particular delay unit of the delay units and each of remaining control lines is not connected to any delay unit, the delay units being used to store row voltage values for the control lines connected to the delay units until a clock signal is supplied to the delay units.

2. A display device as claimed in claim 1, characterized in that a pixel group comprises one pixel.

3. A display device as claimed in claim 1, characterized in that mutually adjoining pixels of one row are alternately connected to the adjoining control lines.

4. A display device as claimed in claim 1, characterized in that the pixels comprise switching elements with control terminals which are connected to the control lines and data terminals which are connected to the data lines.

5. A display device as claimed in claim 1, characterized in that the rows and columns situated at the edges of the display device are covered.

6. A method of controlling a display device as claimed in claim 1.

7. A display device as claimed in claim 1, wherein the delay units are D-flip-flops.

8. A display device with pixels arranged in columns and rows, in which the pixels of a row can be selected by means of a row voltage supplied via control lines, and column voltages that correspond to the image data of the selected pixel to be displayed can be supplied via data lines, wherein mutually adjoining pixel groups arranged in a row or column, consisting of adjoining pixels of a row or column, are connected to adjoining control lines or data lines, as applicable, in alternation, some of the data lines being connected to a plurality of delay units such that only every other data line is connected to a particular delay unit of the delay units and each of remaining control lines is not connected to any delay unit, the delay units being used to store column voltage values for the data lines connected to the delay units until a clock signal is supplied to the delay units.

9. A display device as claimed in claim 8, wherein the delay units are D-flip-flops.

10. A display device as claimed in claim 8, characterized in that a pixel group comprises one pixel.

11. A display device as claimed in claim 8, characterized in that mutually adjoining pixels of a column are connected to the adjoining data lines in alternation.

12. A display device as claimed in claim 8, characterized in that the pixels comprise switching elements with control terminals which are connected to the control lines and data terminals which are connected to the data lines.

13. A display device as claimed in claim 8, characterized in that the rows and columns situated at the edges of the display device are covered.

14. A method of controlling a display device as claimed in claim 8.

* * * * *